US006823153B2

(12) United States Patent
Ueno et al.

(10) Patent No.: US 6,823,153 B2
(45) Date of Patent: Nov. 23, 2004

(54) DEVELOPING DEVICE AND PROCESS CARTRIDGE COMPRISING FIRST AND SECOND SEALING MEMBERS AND ELECTROPHOTOGRAPHIC IMAGE FORMING APPARATUS COMPRISING A DEVELOPING DEVICE COMPRISING FIRST AND SECOND SEALING MEMBERS

(75) Inventors: Takahito Ueno, Shizuoka (JP); Kazunari Murayama, Shizuoka (JP); Nobuharu Hoshi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/347,871

(22) Filed: Jan. 22, 2003

(65) Prior Publication Data

US 2003/0170044 A1 Sep. 11, 2003

(30) Foreign Application Priority Data

Jan. 24, 2002 (JP) ..... 2002-015791

(51) Int. Cl.[7] ..... G03G 15/08
(52) U.S. Cl. ..... 399/103; 399/105
(58) Field of Search ..... 399/103, 94, 105

(56) References Cited

U.S. PATENT DOCUMENTS

| | | | | |
|---|---|---|---|---|
| 4,431,297 A | * | 2/1984 | Ikemoto et al. | 399/105 |
| 5,740,499 A | | 4/1998 | Higeta et al. | 399/105 |
| 5,809,374 A | | 9/1998 | Tsuda et al. | 399/111 |
| 6,078,763 A | | 6/2000 | Hoshi | 399/111 |
| 6,131,011 A | | 10/2000 | Kojima et al. | 399/351 |
| 6,157,792 A | | 12/2000 | Mori et al. | 399/24 |
| 6,178,301 B1 | | 1/2001 | Kojima et al. | 399/98 |
| 6,266,503 B1 | | 7/2001 | Murayama et al. | 399/117 |
| 6,289,189 B1 | | 9/2001 | Numagami et al. | 399/111 |
| 6,298,217 B1 | | 10/2001 | Murayama et al. | 399/358 |
| 6,314,266 B1 | | 11/2001 | Murayama et al. | 399/353 |
| 6,385,416 B1 | | 5/2002 | Horikawa et al. | 399/111 |
| 6,404,996 B1 | | 6/2002 | Mori et al. | 399/24 |
| 6,442,359 B1 | | 8/2002 | Numagami et al. | 399/111 |
| 6,463,233 B2 | | 10/2002 | Kojima et al. | 399/111 |
| 2002/0057924 A1 | | 5/2002 | Ueno et al. | 399/117 |
| 2002/0057928 A1 | | 5/2002 | Yasumoto et al. | 399/167 |
| 2002/0085854 A1 | | 7/2002 | Numagami et al. | 399/90 |
| 2002/0141788 A1 | | 10/2002 | Matsuda et al. | 399/260 |

FOREIGN PATENT DOCUMENTS

| | | | |
|---|---|---|---|
| JP | 61-145570 | * | 7/1986 |
| JP | 4-249273 | * | 9/1992 |

* cited by examiner

*Primary Examiner*—Quana Grainger
(74) *Attorney, Agent, or Firm*—Fitzpatrick, Cella, Harper & Scinto

(57) ABSTRACT

A developing device includes a developing member for developing the latent image, an exposure optical path, a developer containing portion, a vent port for allowing air in the inside of the developer containing portion to pass therethrough, a first sheet member for preventing scattering of the developer into the exposure optical path, disposed between the exposure optical path and the developing member and contacted with an electrophotographic photosensitive member, a first sealing member for preventing leaking of the developer from the developer containing portion, contacted with one end portion of the electrophotographic photosensitive member in its longitudinal direction, and a second sealing member for preventing leaking of the developer from the developer containing portion, contacted with another end portion of the electrophotographic photosensitive member in its longitudinal direction.

18 Claims, 9 Drawing Sheets

DEVELOPING DEVICE AND PROCESS CARTRIDGE COMPRISING FIRST AND SECOND SEALING MEMBERS AND ELECTROPHOTOGRAPHIC IMAGE FORMING APPARATUS COMPRISING A DEVELOPING DEVICE COMPRISING FIRST AND SECOND SEALING MEMBERS

BACKGROUND OF THE INVENTION

1. Field of the Invention

The present invention relates to a developing device or a process cartridge which is used in an electrophotographic image forming apparatus such as an electrophotographic copier, an electrophotographic printer or the like, and an electrophotographic image forming apparatus which uses the developing device or the process cartridge, for example.

Here, the electrophotographic image forming apparatus forms an image on a recording medium using an electrophotographic image forming process. Examples of electrophotographic image forming apparatus include an electrophotographic copier, an electrophotographic printer (an LED printer, a laser beam printer or the like), an electrophotographic facsimile device, an electrophotographic word processor and the like.

Here, the process cartridge is an assembled body formed by integrally forming at least a developing means and an electrophotographic photosensitive member into a cartridge and this cartridge can be replaceably mounted on or dismounted from an image forming apparatus body.

2. Description of the Related Art

Conventionally, there has been adopted a process cartridge system in which a photosensitive drum, charging means, developing means, cleaning means and the like are integrally formed into a cartridge and the cartridge is replaceably mounted on or dismounted from an apparatus body of an image forming apparatus.

Thanks to this cartridge system, the operability is further enhanced so that the maintenance of the above-mentioned process means such as the charging means, the developing means, the cleaning means and the like can be easily performed by a user himself. Accordingly, this cartridge system has been popularly used in the apparatus body of the image forming apparatus.

Further, there has been also realized a cartridge constitution in which the process means is classified into process means having a long life time and a process means having a short life time and these respective process means are formed into cartridges and can be used in accordance with the life time of the main process means. For example, a developing cartridge in which a toner accommodating portion and the developing means are integrally formed, a drum cartridge in which the photosensitive drum, the charging means and the cleaning means are integrally formed and the like are adopted.

In such a cartridge-type image forming apparatus, as a developing method which has been conventionally used, a so-called magnetic brush developing method has been known. In this magnetic brushing method, using a two component developer consisting of non-magnetic toner and a magnetic carrier, a magnetic brush is formed on a surface of a developer bearing member (also referred to as a developing sleeve hereinafter) which arranges a magnet in the inside thereof. Then, this magnetic brush is brought into slidable and frictional contact with or is arranged in the vicinity of the photosensitive drum which is arranged to face the developing sleeve in an opposed manner while maintaining a minute developing gap therebetween. Subsequently, an electric field is continuously applied between the developing sleeve and the photosensitive drum. Accordingly, the developing is performed by repeatedly performing the transfer of the toner particle from the developing sleeve side to the photosensitive drum side and the inverse transfer of such toner particles.

Here, in this magnetic brush developing method, the non-magnetic toner and the magnetic carrier are agitated and are transported by a screw and are eventually supplied to the developing sleeve. Such a constitution has been conventionally popularly adopted.

Recently, along with the demand for high speed operation of a printer, not to mention the peripheral speed of the photosensitive drum, the peripheral speed of the developing sleeve in the inside of the developing device is increased, thus giving rise to the elevation of the internal pressure and the occurrence of an air flow in the inside of the developing device.

There exists a possibility that the developer scatters through a minute gap due to these phenomena. The scattering of the developer smears in the inside of the process cartridge, a scanner and the electrophotographic image forming apparatus including the developing device.

SUMMARY OF THE INVENTION

Accordingly, it is an object of the present invention to provide a developing device, a process cartridge and an electrophotographic image forming apparatus which can prevent leaking of a developer.

It is another object of the present invention to provide a developing device, a process cartridge and an electrophotographic image forming apparatus which can prevent scattering of a developer into an exposure optical path which may be caused by leaking of the developer.

It is still another object of the present invention to provide a developing device, a process cartridge and an electrophotographic image forming apparatus which can prevent the elevation of the internal pressure in the inside of a developer containing portion.

It is a further object of the present invention to provide a developing device for developing a latent image formed on an electrophotographic photosensitive member used in an electrophotographic image forming apparatus, wherein the developing device includes a developing member for developing the latent image formed on the electrophotographic photosensitive member, an exposure optical path for guiding an exposure light emitted from exposure means mounted in a body of the electrophotographic image forming apparatus to the electrophotographic photosensitive member, a developer containing portion for containing a developer which is used by the developing member for developing the latent image, a vent port for allowing air in the inside of the developer containing portion to pass therethrough, a first sheet member for preventing scattering of the developer into the exposure optical path, the first sheet member being disposed between the exposure optical path and the developing member and being in contact with the electrophotographic photosensitive member in the longitudinal direction of the electrophotographic photosensitive member, a first sealing member for preventing leaking of the developer in the inside of the developer containing portion from the developer containing portion, the first sealing member being in contact with one end portion of the electrophotographic photosensitive member in the longitudinal direction of the electrophotographic photosensitive member, and a second sealing member for preventing leaking of the developer in the inside of the developer containing portion from the developer containing portion, the second sealing member being in contact with another end portion of the electrophotographic photosensitive member in the longitudinal direction of the electrophotographic photosensitive member.

It is a still further object of the present invention to provide a process cartridge which is detachably attachably mounted on a body of an electrophotographic image forming apparatus, wherein the process cartridge includes an electrophotographic photosensitive member, a developing member for developing the latent image formed on the electrophotographic photosensitive member, an exposure optical path for guiding an exposure light emitted from exposure means mounted in a body of the electrophotographic image forming apparatus to the electrophotographic photosensitive member, a developer containing portion for containing a developer which is used by the developing member for developing the latent image, a vent port for allowing air in the inside of the developer containing portion to pass therethrough, a first sheet member for preventing scattering of the developer into the exposure optical path, the first sheet member being disposed between the exposure optical path and the developing member and being in contact with the electrophotographic photosensitive member in the longitudinal direction of the electrophotographic photosensitive member, a first sealing member for preventing leaking of the developer in the inside of the developer containing portion from the developer containing portion, the first sealing member being in contact with one end portion of the electrophotographic photosensitive member in the longitudinal direction of the electrophotographic photosensitive member, and a second sealing member for preventing leaking of the developer in the inside of the developer containing portion from the developer containing portion, the second sealing member being in contact with another end portion of the electrophotographic photosensitive member in the longitudinal direction of the electrophotographic photosensitive member.

It is a still further object of the present invention to provide an electrophotographic image forming apparatus for forming an image on a recording medium, wherein the electrophotographic image forming apparatus includes (a) exposure means, (b) a developing device for developing a latent image formed on an electrophotographic photosensitive member used in the electrophotographic image forming apparatus, the developing device including a developing member for developing the latent image formed on the electrophotographic photosensitive member, an exposure optical path for guiding an exposure light emitted from exposure means mounted in a body of the electrophotographic image forming apparatus to the electrophotographic photosensitive member, a developer containing portion for containing a developer which is used by the developing member for developing the latent image, a vent port for allowing air in the inside of the developer containing portion to pass therethrough, a first sheet member for preventing scattering of the developer into the exposure optical path, the first sheet member being disposed between the exposure optical path and the developing member and being in contact with the electrophotographic photosensitive member in the longitudinal direction of the electrophotographic photosensitive member, a first sealing member for preventing leaking of the developer in the inside of the developer containing portion from the developer containing portion, the first sealing member being in contact with one end portion of the electrophotographic photosensitive member in the longitudinal direction of the electrophotographic photosensitive member, and a second sealing member for preventing leaking of the developer in the inside of the developer containing portion from the developer containing portion, the second sealing member being in contact with another end portion of the electrophotographic photosensitive member in the longitudinal direction of the electrophotographic photosensitive member, and (c) conveying means for conveying the recording medium.

It is another object of the present invention to provide an electrophotographic image forming apparatus for forming an image on a recording medium on which a process cartridge can be detachably attachably mounted, wherein the electrophotographic image forming apparatus includes (a) exposure means, (b) mounting means for detachably mounting the process cartridge which includes an electrophotographic photosensitive member, a developing member for developing the latent image formed on the electrophotographic photosensitive member an exposure optical path for guiding an exposure light emitted from exposure means mounted in a body of the electrophotographic image forming apparatus to the electrophotographic photosensitive member, a developer containing portion for containing a developer which is used by the developing member for developing the latent image, a vent port for allowing air in the inside of the developer containing portion to pass therethrough, a first sheet member for preventing scattering of the developer into the exposure optical path, the first sheet member being disposed between the exposure optical path and the developing member and being in contact with the electrophotographic photosensitive member in the longitudinal direction of the electrophotographic photosensitive member, a first sealing member for preventing leaking of the developer in the inside of the developer containing portion from the developer containing portion, the first sealing member being in contact with one end portion of the electrophotographic photosensitive member in the longitudinal direction of the electrophotographic photosensitive member, and a second sealing member for preventing leaking of the developer in the inside of the developer containing portion from the developer containing portion, the second sealing member being in contact with another end portion of the electrophotographic photosensitive member in the longitudinal direction of the electrophotographic photosensitive member, and (c) conveying means for conveying the recording medium.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENT

Preferred embodiments of the present invention are explained in an illustrative manner in conjunction with the attached drawings hereinafter. However, the sizes, materials, shapes and relative arrangements of constitutional parts described in these embodiments should not be construed to limit the scope of the present invention to these values unless otherwise specified in the specification.

In the following description, the longitudinal direction is defined as a direction which is orthogonal to the conveying direction of a recording medium 52 and is a direction identical to an axial direction of an electrophotographic photosensitive member which constitutes an image bearing member (hereinafter referred to as a photosensitive drum 2). Further, the term "left and right" is defined as the left and right directions as viewed from the conveying direction of the recording medium 52. Further, the term "upper and lower" means the upper and lower positions in a state that a cartridge is mounted in the electrophotographic image forming apparatus.

Explanation of the Entire Electrophotographic Image Forming Apparatus

Figure 1:
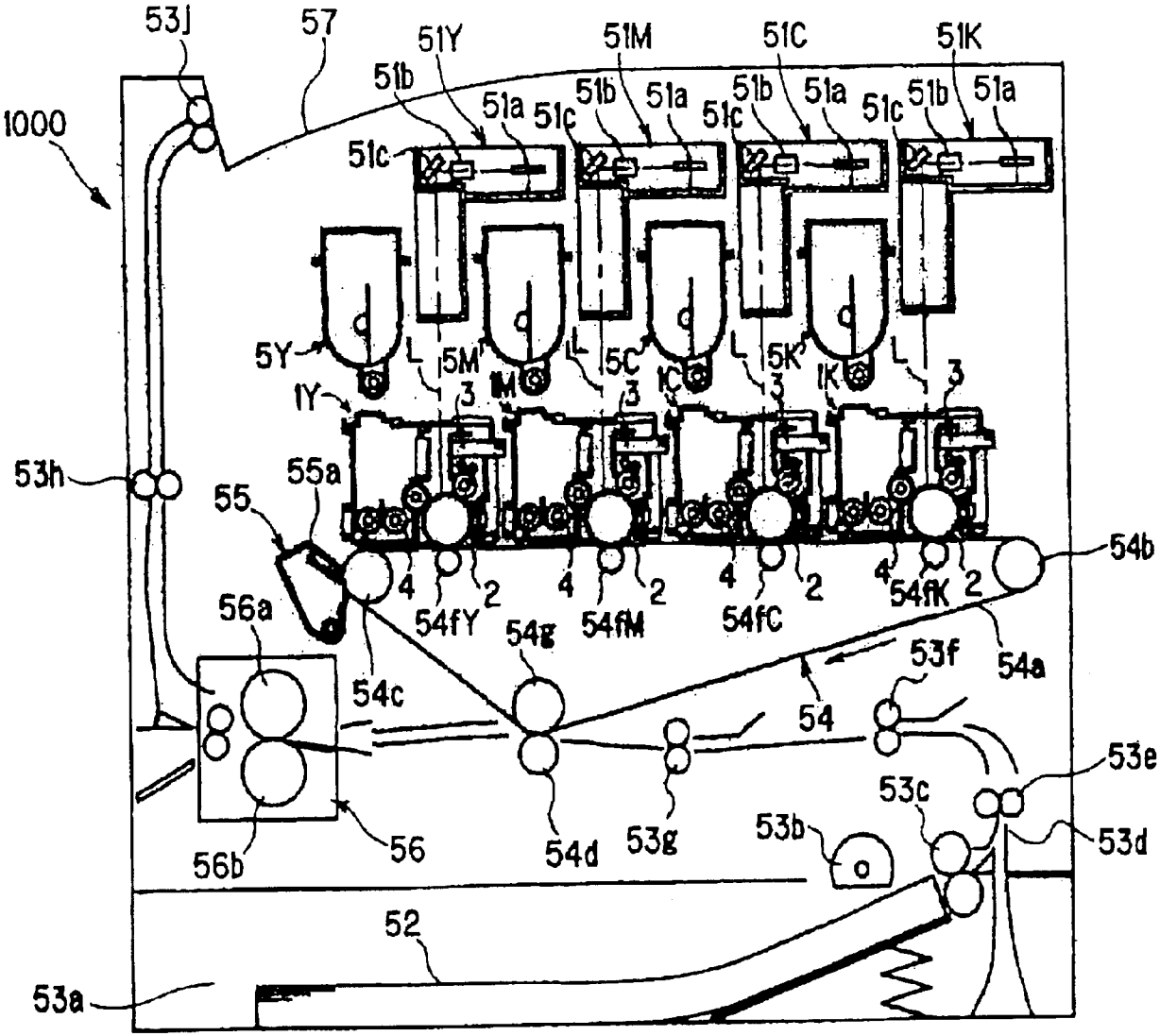
FIG. 1 is a cross-sectional view showing an image forming apparatus body according to one embodiment of the present invention.

First, the entire configuration of a color electrophotographic image forming apparatus will be schematically explained in conjunction with FIG. 1.

FIG. 1 is an explanatory view showing the entire configuration of a color laser beam printer which constitutes one form of a color toner image forming apparatus.

An image forming portion of an apparatus body 1000 of the color laser beam printer includes four process cartridges 1Y, 1M, 1C, and 1K (yellow, magenta, cyan, black) each having a photosensitive drum 2 which constitutes an image bearing member and exposure means 51Y, 51M, 51C, and 51K (laser beam optical scanning systems) which are arranged in parallel above the process cartridges 1Y, 1M, 1C, and 1K corresponding to respective colors.

Below the above-mentioned image forming portion, feeding means for feeding the recording medium 52, an intermediate transfer belt 54*a* for transferring a toner image formed on the photosensitive drum 2, and a secondary transfer roller 54*d* for transferring a toner image on the intermediate transfer belt 54*a* onto the recording medium 52 are arranged.

Further, below the above-mentioned image forming portion, a fixing device 56 which constitutes fixing means for fixing the recording medium 52 onto which a toner image has been transferred and a tray 57 which stacks the recording medium 52, which is discharged outside the image forming apparatus, are disposed.

Here, the recording medium 52 is, for example, a paper, an OHP sheet, a cloth or the like.

The image forming apparatus of this embodiment is a cleanerless system. Thus, toner remaining on the photosensitive drum 2 after transfer is carried in the developing device 4 which constitutes developing means and a cleaner which is used for exclusively collecting and reserving toner remaining after transfer is not provided in the inside of the process cartridges.

Subsequently, the configurations of the respective portions of the above-mentioned image forming apparatus are sequentially explained in detail.

Feeding Means

The feeding means feeds the recording medium 52 to the image forming portion. The feeding means mainly includes a feed cassette 53*a* containing stacked sheets of a recording medium 52, a feed roller 53*b*, an anti-double-feed retard roller 53*c*, a feed guide 53*d* and a registration roller 53*g*.

The feed roller 53*b* is rotationally driven in accordance with an image forming operation and separates and feeds the recording medium 52 in the feed cassette 53*a* for every one sheet.

The recording medium 52 is guided with the feed guide 53*d* and is conveyed to the registration roller 53*g* through the conveying rollers 53*e*, 53*f*.

Immediately after the recording medium 52 is conveyed to the registration roller 53*g*, the registration roller 53*g* is in a non-rotation mode. A skewing of the recording medium 52 is corrected by hitting a leading end of the recording medium 52 to a nip portion of the registration roller 53*g*.

During the image forming operation, the registration roller 53*g* performs a non-rotary operation for allowing the recording medium 52 to rest/wait and a rotary operation for conveying the recording medium 52 to the intermediate transfer belt 54*a* in a given sequence. Thereafter, the registration roller 53*g* performs the registering or the alignment between the toner image and the recording medium 52 at the time of a transfer step which is a next step.

Process Cartridge

In each of the process cartridges 1Y, 1M, 1C, and 1K (hereinafter also referred to as "process cartridge 1"), a charging device 3 which constitutes the charging means and a developing device 4 are arranged around the photosensitive drum 2 and they are integrally formed. The process cartridge 1 can be easily detached by a user from the apparatus body and can be replaced when the life of the photosensitive drum 2 expires.

In this embodiment, for example, the number of rotations of the photosensitive drum 2 is counted, and when the number of rotations exceeds a given count number, an alarm indicates that the life of the process cartridge 1 has expired.

The photosensitive drum 2 in this embodiment is made of a negatively charged organic photosensitive member. The photosensitive drum 2 has a photosensitive layer that is usually used on an aluminum drum substrate having a diameter of about 30 mm and provides a charge injection layer on an outermost surface layer thereof. Further, the photosensitive drum 2 is rotatably driven at a given process speed, that is, about 117 mm/sec in this embodiment.

As the charge injection layer of the photosensitive drum 2, a coated layer, which is made of a material in which, for example, $SnO_2$ ultra fine particles as conductive fine particles are dispersed into an insulating resin binder, is used.

Figure 4:
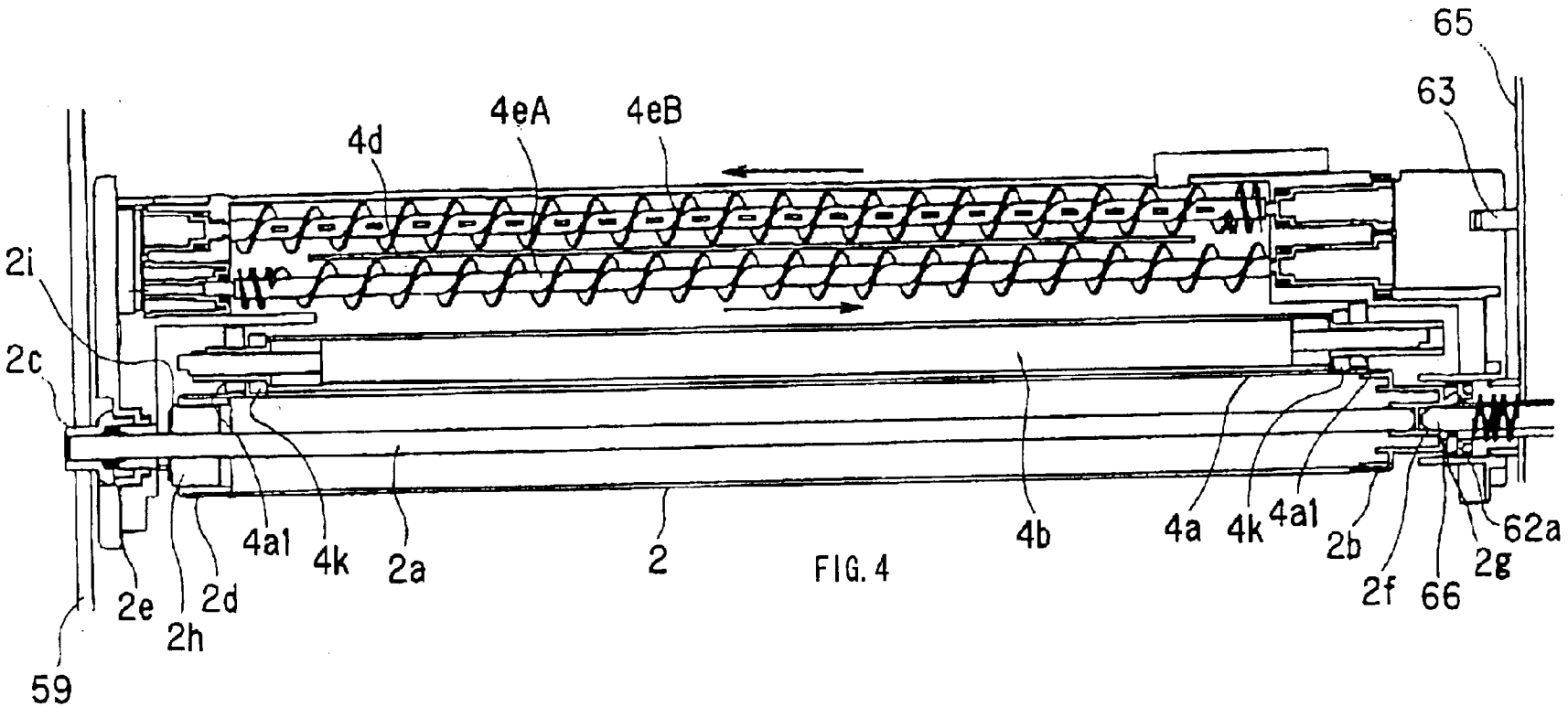
FIG. 4 is a longitudinal cross-sectional view showing the process cartridge according to this embodiment

As shown in FIG. 4, a drum flange 2*b* is fixed to a rear-side end portion of the photosensitive drum 2 and a non-driving flange 2*d* is fixed to a front-side end portion. A drum shaft 2*a* penetrates the centers of the drum flange 2*b* and the non-driving flange 2*d* such that the drum shaft 2*a*, the drum flange 2*b* and the non-driving flange 2*d* are integrally rotated. That is, the photosensitive drum 2 is rotated about the axis of the drum shaft 2*a*.

The front-side end portion of the drum shaft 2*a* is rotatably supported on a bearing 2*e*. The bearing 2*e* is fixed to a bearing case 2*c*. Further, the bearing case 2*c* is fixed to a frame of the process cartridge 1.

Charging Means

The charging device 3 which constitutes charging means uses a contact charging method. In this embodiment, a charging roller 3*a* is-used as a charging member.

Figure 2:
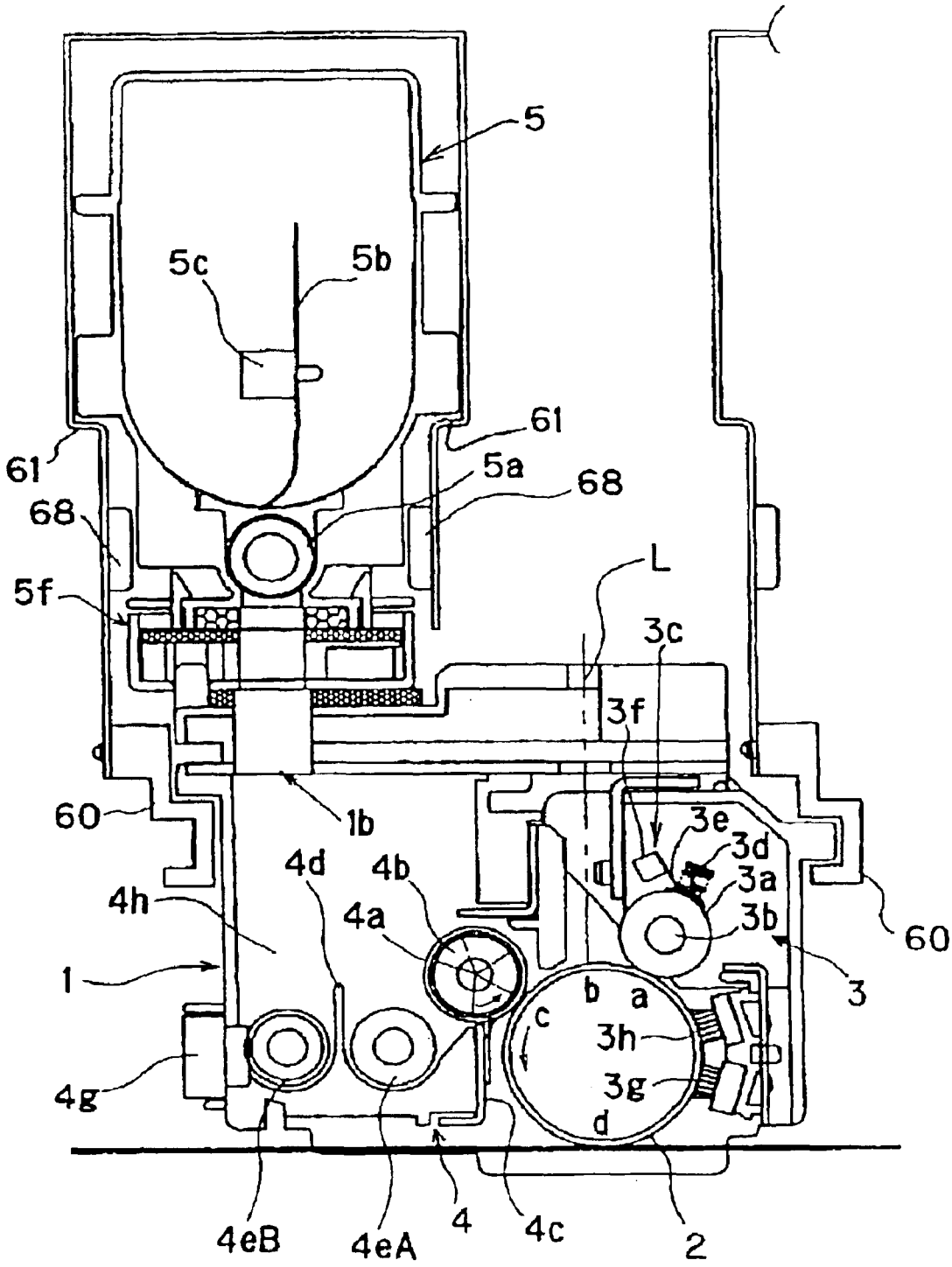
FIG. 2 is a cross-sectional view showing a process cartridge and a toner replenishing container according to this embodiment.

As shown in FIG. 2, the charging roller 3*a* has both end portions of a core 3*b* thereof rotatably supported on bearing members not shown in the drawings. Further, the charging roller 3*a* is biased toward the photosensitive drum 2 due to a compression spring 3*d* such that the charging roller 3*a* is brought into pressure contact with a surface of the photosensitive drum 2 with a given pressing force and is rotated in accordance with the rotation of the photosensitive drum 2.

A charging roller cleaning member 3*c* includes, in this embodiment, a cleaning film 3*e* having flexibility.

The cleaning film 3*e* is arranged parallel to the longitudinal direction of the charging roller 3*a*. Further, the cleaning film 3*e* has one end thereof fixed to a support member 3*f* which performs a reciprocating movement of a fixed amount in the longitudinal direction of the charging roller 3*a*, while the cleaning film 3*e* defines a contact nip with the charging roller 3*a* on a face thereof in the vicinity of a free end side thereof.

Due to the reciprocating movement of the support member 3*f* by a fixed amount in the longitudinal direction due to driving means (not shown in the drawings), a surface of the charging roller 3*a* is scraped by the cleaning film 3*e*. Accordingly, fouling (fine powdery toner, external additives and the like) on the surface of the charging roller 3*a* is removed.

Here, the image forming apparatus of this embodiment adopts a cleanerless system. This cleanerless system is explained hereinafter.

Cleanerless System

The summary of the cleanerless system in the image forming apparatus of this embodiment is explained first. That is, in the cleanerless system, the toner remaining after transfer on the photosensitive drum 2 is, along with the subsequent rotation of the photosensitive drum 2, allowed to pass through a charging portion "a" and an exposure portion "b" and then is carried to a developing portion "c" and is cleaned (collected) simultaneously with developing by the developing device 4.

Since the toner remaining after transfer on the photosensitive drum 2 passes through the exposure portion "b", the exposure step is performed over the toner remaining after transfer. However, since the quantity of toner remaining after transfer is small, no significant influence takes place.

However, toner having the normal polarity, toner having the inverse polarity (inverted toner) and toner with an insufficient charging quantity are mixed in the toner remaining after transfer. When the inverted toner and the toner with an insufficient charging quantity pass through the charging portion "a", they are adhered to the charging roller 3*a* and hence, the charging roller 3*a* is contaminated with the toner which exceeds an allowable quantity, thus giving rise to a defective charging.

Further, to effectively perform the cleaning of the toner remaining after transfer on the surface of the photosensitive drum 2 simultaneously with developing by the developing device 4, it is necessary that the charged polarity of the toner remaining after transfer on the photosensitive drum 2 carried to the developing portion "c" assumes the normal polarity and the charging quantity is a charging quantity with which the developing device 4 can develop a charged latent image on the photosensitive drum 2. That is, with respect to the inverted toner and the toner having an improper charging quantity, it is difficult to remove and collect them from the photosensitive drum 2 to the developing device 4, thus giving rise to the defective image.

Accordingly, in this embodiment, at a position downstream of the transfer portion "d" with respect to the photosensitive drum 2, means "3*g*" for making post-transfer remaining toner (residual developer image) uniform, which can disperse the transfer residual toner uniformly on the surface of the photosensitive drum 2, is provided.

Further, at a position downstream of this means 3*g* for making post-transfer remaining toner uniform in the rotational direction of the photosensitive drum 2 and upstream of the charging portion "a" in the rotational direction of the photosensitive drum 2, toner (developer) charging control means 3*h*, which arranges the charging polarity of the toner remaining after transfer to the negative polarity, which is the normal polarity, is provided.

By providing the means 3*g* for making post-transfer remaining toner uniform, even when the toner remaining after transfer in a pattern on the photosensitive drum 2, which is carried from the transfer portion "d" to the toner charging control means 3*h*, is large in quantity, the toner is dispersed and distributed over the surface of the photosensitive drum 2 so that the pattern is dissipated. Accordingly, there is no possibility that the toner is concentrated at a portion of the toner charging control means 3*h* so that the overall normal polarity charging treatment of the toner remaining after transfer can be sufficiently performed by the toner charging control means 3*h*. Accordingly, it is possible to effectively prevent the toner remaining after transfer from adhering to the charging roller 3*a*. Further, it is also possible to prevent the occurrence of a ghost image of the pattern of toner remaining after transfer.

According to this embodiment, the means 3*g* for making post-transfer remaining toner uniform and the toner charging control means 3*h* are formed of a brush-like member having a proper conductivity and bring brush portions thereof into contact with the surface of the photosensitive drum 2.

Further, the means 3*g* for making post-transfer remaining toner uniform and the toner charging control means 3*h* are arranged to move (reciprocating movement) in the longitudinal direction of the photosensitive drum 2 by a driving source not shown in the drawing. Due to such a constitution, it is possible to obviate a state in which the means 3*g* for making post-transfer remaining toner uniform and the toner charging control means 3*h* are fixedly held continuously at the same positions along the photosensitive drum 2. Accordingly, even when excessively charged portions or the charging shortage portions are present due to irregularities in resistance of the toner charging control means 3*h*, for example, they do not always take place at the same portions of the surface of the photosensitive drum 2. That is, the occurrence of melting of toner on the photosensitive drum 2 attributed to the excessive charging of an extremely minute toner remaining after transfer or the occurrence of adhesion of the toner remaining after transfer to the charging roller 3*a* attributed to the shortage of charging can be prevented or attenuated.

Exposure Means

In this embodiment, exposure to the above-mentioned photosensitive drum 2 is carried out by the exposure means 51Y, 51M, 51C, 51K which constitute the laser exposure means. That is, when an image signal is transmitted from the apparatus body 1000, a laser beam L modulated in response to this signal is applied to the uniformly charged surface of the photosensitive drum 2 by scanning. An electrostatic latent image corresponding to the image information is selectively formed on the surface of the photosensitive drum 2.

Each of the exposure means 51Y, 51M, 51C, 51K is composed of a solid-state laser element (not shown in the drawing), a polygon mirror 51*a*, an imaging lens 51*b*, a reflective mirror 51*c* and the like.

The solid-state laser element is ON/OFF light emission controlled at a desired timing with a light emission signal generator (not shown in the drawing) based on the inputted image signal in the exposure means 51Y, 51M, 51C and 51K. The laser beam L emitted from the solid-state laser element is converted into a flux of substantially parallel beams with a collimator lens system (not shown in the drawing) and is scanned with the polygon mirror 51*a* which is rotated at a high speed. And the beam is imaged on the photosensitive drum 2 in a spot shape through the imaging lens 51*b* and the reflective mirror 51*c*.

Thus, the laser beam scanning exposure in the main scanning direction and the exposure in the sub-scanning direction due to the rotation of the photosensitive drum 2 are applied onto the surface of the photosensitive drum 2 to thereby obtain an exposure distribution in accordance with the image signal.

That is, by the irradiation and the non-irradiation of laser beam L, a surface potential reduced highlight potential and a surface potential non-reduced shadow potential are respectively formed. And by a contrast between the highlight potential and the shadow potential, an electrostatic latent image corresponding to the image information is formed.

Developing Means

The developing device 4 which constitutes the developing means is a two-component contact developing device (two-component magnetic brush developing device) and holds, as shown in FIG. 2, a developer which is composed of carrier and toner on a developing sleeve 4*a*. The developing sleeve 4*a* constitutes a developer bearing member and a magnet roller 4*b* disposed in the inside of the developing sleeve 4*a*.

The developing sleeve 4*a* is provided with a regulating blade 4*c* which constitutes a layer thickness restricting member, wherein a desired gap is formed between the developing sleeve 4*a* and the regulating blade 4*c*. By the rotation of the developing sleeve 4*a* in the direction indicated by an arrow, the developer which is carried on the developer sleeve 4*a* is regulated to a thin layer by the regulating blade 4*c*.

The developing sleeve 4*a* allows, as shown in FIG. 4, a developing spacer 4*k* to be rotatably fitted on narrow-diametered journal portions 4*a*1 provided at both sides thereof. Accordingly, the developing sleeve 4*a* is arranged to define a given gap between the developing sleeve 4*a* and the photosensitive drum 2, wherein at the time of developing, the developing is performed in a state that the developer formed on the developing sleeve 4*a* is in contact with the photosensitive drum 2.

The developing sleeve 4*a* is rotatably driven at the developing portion "c" at a given peripheral speed in the direction indicated by an arrow which is a direction opposite to the rotational direction of the photosensitive drum 2.

The toner used in this embodiment is a negatively charged toner with an average particle diameter of 6 $\mu$m. Further, as a magnetic carrier, a magnetic carrier having a saturated magnetization of 205 emu/cm$^3$ and an average particle diameter of 35 $\mu$m is used. Further, as a developer, a mixture of toner and carrier mixed at the weight ratio of 6:94 is used.

A developer containing portion 4*h* in which a developer is circulated is divided into two portions with a partition wall 4*d* extending in the longitudinal direction except for both end portions of the developer containing portion 4*h*. Here, agitating screws 4*e*A, 4*e*B are placed so as to sandwich the partition wall 4*d*.

The toner replenished from toner replenishing containers 5Y, 5M, 5C, 5K (hereinafter also referred to as a toner replenishing container 5), as shown in FIG. 4, falls down on the rear side of the agitating screw 4*e*B and is agitated while being fed to the front side in the longitudinal direction and is passed through a portion without the partition wall 4*d* on the front side end. Then, the toner is further fed to the rear side in the longitudinal direction with the agitating screw 4*e*A and is passed through a portion without the partition wall 4*d* on the rear side and is agitated while being fed using the agitating screw 4*e*B. Thus, the circulation is repeated.

Developing steps of visualizing an electrostatic latent image formed on the photosensitive drum 2 by the two-component magnetic brush process using the developing device 4 and the circulation system of developer are explained hereinafter.

By the rotation of the developing sleeve 4*a*, a developer in the developer containing portion 4*h* is drawn to the surface of the developing sleeve 4*a* with a draw-up pole of the magnet roller 4*b* and is fed.

In the process of feeding the developer, the layer thickness of developer is regulated with the regulating blade 4*c* placed vertically to the developing sleeve 4*a*, and a thin layered developer is formed on the developing sleeve 4*a*.

When the thin layered developer on the developing sleeve 4*a* is fed to a developing pole corresponding to the developing portion "c", a magnetic brush is formed by a magnetic force. An electrostatic latent image on the surface of the photosensitive drum 2 is developed by toner in the developer which stands like the ears of rice as a toner image. The electrostatic latent image is developed while reversed in this embodiment.

A thin layered developer on the developing sleeve 4*a* which has passed through a developing portion "c" is subsequently fed into the developer containing portion 4*h* by the rotation of the developing sleeve 4*a* and leaves the surface of the developing sleeve 4*a* by a repulsion magnetic field in a carrying pole to return to a developer reservoir in the developer containing portion 4*h*.

A direct current (DC) voltage and an alternating current (AC) voltage are applied from a power supply (not shown in the drawing) to the developing sleeve 4*a*. In this embodiment, a DC voltage of −500 V and an AC voltage of peak-to-peak voltage of 1500 V at the frequency of 2000 Hz are applied to selectively develop only the exposed portions having a highlight potential of the photosensitive drum 2 exposed by the exposure portion "b".

When the AC voltage is applied in the two-component developing process in general, the developing efficiency is increased to obtain an image having high quality. However, there arises a fear that fogging may easily occur. Therefore, prevention of the fogging is usually realized by providing the potential difference between the DC voltage applied to the developing sleeve 4*a* and the surface potential of the photosensitive drum 2. To be more specific, the bias voltage of a potential difference between the highlight potential of the exposed portion and the shadow potential of the non-exposed portion of the photosensitive drum 2 is applied.

When toner is consumed by developing, the toner density in a developer is decreased. In this embodiment, a sensor 4*g* which detects the toner density is placed at a position in the vicinity of the outer periphery surface of the agitating screw 4*e*B. When the sensor 4*g* detects that the toner density in the developer is further decreased than a desired density level, an instruction to replenish toner from the toner replenishing container 5 to the developing device 4 is issued. By this toner replenishing operation, the toner density of the developer in the inside of the developer containing portion 4*h* can be always maintained and controlled at a given level.

Toner Replenishing Container

The toner replenishing containers 5Y, 5M, 5C, 5K are placed above the process cartridges 1Y, 1M, 1C, 1K in parallel to each other and are mounted from the front side of the apparatus body 1000.

As shown in FIG. 2, in the toner replenishing container 5, an agitating plate 5*b* which is fixed to an agitating shaft 5*c* and a screw 5*a* are disposed. A discharge port portion 5*f* which serves for discharging toner is formed on the bottom surface of the container.

The screw 5*a* and the agitating shaft 5*c* have respective both ends thereof rotatably supported by bearings. A drive coupling (concave) is placed on one tip end thereof. The drive coupling (concave) receives driving transmission from a drive coupling (convex) of the apparatus body 1000 and is rotatably driven.

The outer configuration of the screw 5*a* has a spiral lib shape and the twist direction of the spiral shape is reversed while setting the discharge port portion 5*f* as the center.

By the rotation of the drive coupling (convex), the screw 5*a* is rotated in a desired rotational direction. Due to such an operation, toner is fed toward the discharge port portion 5*f* and freely falls down from an opening of the discharge port portion 5*f*, to thereby replenish toner in the process cartridges 1.

The distal end portion of the agitating plate 5*b* in the radial direction of rotation is slanted. When the distal end portion is brought into sliding contact with the inner wall surface of the toner replenishing container 5, the distal end portion contacts the surface at an angle. To be more specific, the distal end side of the agitating plate 5*b* is twisted to form a spiral-shape. Thus, by the twist inclination on the distal end side of the agitating plate 5*b*, the feeding force in the axial direction of the agitating shaft 5*c* is generated so that toner is fed in the longitudinal direction.

The toner replenishing container 5 of this embodiment is not limited to the two component developing method and toner can be replenished to process cartridges or developing cartridges which adopt the one component developing method. Further, it is needless to say that powdery material which can be contained in the toner replenishing container is not limited to toner and a so-called developer, which is a mixture of toner and magnetic carrier, can be filled in the container.

Transfer Means

An intermediate transfer unit 54 which constitutes transfer means secondarily collectively transfers a plurality of toner images which have been sequentially primarily transferred from the photosensitive drums 2 and superimposed on one another to the recording medium 52.

The intermediate transfer unit 54 is provided with an intermediate transfer belt 54*a* running in a direction indicated by an arrow and runs in the arrow direction at a peripheral speed substantially the same as the outer peripheral speed of the photosensitive drum 2. The intermediate transfer belt 54*a* is an endless belt with a circumferential length of about 940 mm and is extended around three rollers consisting of a drive roller 54*b*, a secondary transfer opposed roller 54*g* and a driven roller 54*c*.

Further, in the inside of the intermediate transfer belt 54*a*, transfer charging rollers 54*f*Y, 54*f*M, 54*f*C, 54*f*K are rotatably placed at positions respectively opposed to the photosensitive drums 2 and are pushed in the respective central directions of the photosensitive drums 2.

The transfer charging rollers 54*f*Y, 54*f*M, 54*f*C, 54*f*K are energized from a high voltage power supply (not shown in the drawing) to perform charging with a polarity opposite to that of toner from the back side of the intermediate transfer belt 54*a* and primarily transfer the toner images on the photosensitive drums 2 to the upper surface of the intermediate transfer belt 54*a* sequentially.

A secondary transfer roller 54*d* which constitutes a transfer member is in pressure contact with the intermediate transfer belt 54*a* at a position opposed to the secondary transfer opposed roller 54*g* in the secondary transfer portion. The secondary transfer roller 54*d* can perform an up-and-down motion in the drawing and is also rotated. At this time, bias is simultaneously applied to the intermediate transfer belt 54*a* so that the toner image on the intermediate transfer belt 54*a* is transferred to the recording medium 52.

In this step, the intermediate transfer belt 54*a* and the secondary transfer roller 54*d* are respectively driven. When the recording medium 52 enters the secondary transfer portion, a given bias is applied to the secondary transfer roller 54*d* and the toner image on the intermediate transfer belt 54*a* is secondarily transferred to the recording medium 52.

Simultaneously with performing of the transfer step in which the recording medium 52 sandwiched between the intermediate transfer belt 54*a* and the secondary transfer roller 54*d* is transferred, the recording medium 52 is fed at a given speed in the leftward direction in the drawing to a fixing device 56, which constitutes fixing means functioning in the next step.

At a given position on the intermediate transfer belt 54*a* of the most downstream side in the transfer process, a cleaning 26 unit 55 which can be brought into contact with and can be separated from the surface of the intermediate transfer belt 54*a* is provided. The cleaning unit 55 removes toner remaining on the surface of the intermediate transfer belt 54*a* after the secondary transfer.

A cleaning blade 55*a* for removing the toner remaining on the surface of the intermediate transfer belt 54*a* after the secondary transfer is placed in the inside of the cleaning unit 55.

The cleaning unit 55 is swingably mounted at the rotation center (not shown in the drawing). The cleaning blade 55*a* is brought into pressure contact with the intermediate transfer belt 54*a* in an inroading direction.

The transfer residual toner drawn into the cleaning unit 55 is fed to a waste toner tank (not shown in the drawing) with a feeding screw and is stored therein.

Here, as the intermediate transfer belt 54*a*, an intermediate transfer belt made of polyimide resin can be used in this embodiment. The material of the intermediate transfer belt 54*a* is not limited to the polyimide resin, and plastics such as polycarbonate resin, polyethylene terephthalate resin, polyvinylidene fluoride resin, polyethylene naphthalate resin, polyether ether ketone resin, polyether sulfone resin, and polyurethane resin, and fluorine series rubber and silicone series rubber can be preferably used.

Fixing Means

A toner image formed on the photosensitive drum 2 with the developing device 4 is transferred to the recording medium 52 through the intermediate transfer belt 54*a*. Then, the fixing device 56, which constitutes fixing means, fixes the toner image transferred to the recording medium 52 to the recording medium 52 with heat.

As shown in FIG. 1, the fixing device 56 is provided with a fixing roller 56*a* for imparting heat to the recording medium 52 and a pressure roller 56*b* for bringing the recording medium 52 into pressure contact with the fixing roller 56*a*. Each of the fixing roller 56*a* and the pressure roller 56*b* is formed of a hollow roller. Each of the fixing roller 56*a* and the pressure roller 56*b* has a heater (not shown in the drawing) therein.

The fixing roller 56*a* and the pressure roller 56*b* are rotatably driven to feed the recording medium 52 simultaneously.

That is, the recording medium 52 holding the toner image thereon is fed using the fixing roller 56*a* and the pressure roller 56*b* and, at the same time, the toner image is fixed to the recording medium 52 by being applied with heat and pressure. The recording medium 52 with the fixed the toner image is discharged through discharge rollers 53*h*, 53*j* and is stacked on a tray 57 on the apparatus body 1000.

Mounting of Process Cartridge and Toner Replenishing Container

Next, mounting procedures of the process cartridges 1 and the toner replenishing containers 5 will be described with reference to FIG. 2 to FIG. 4.

Figure 3:
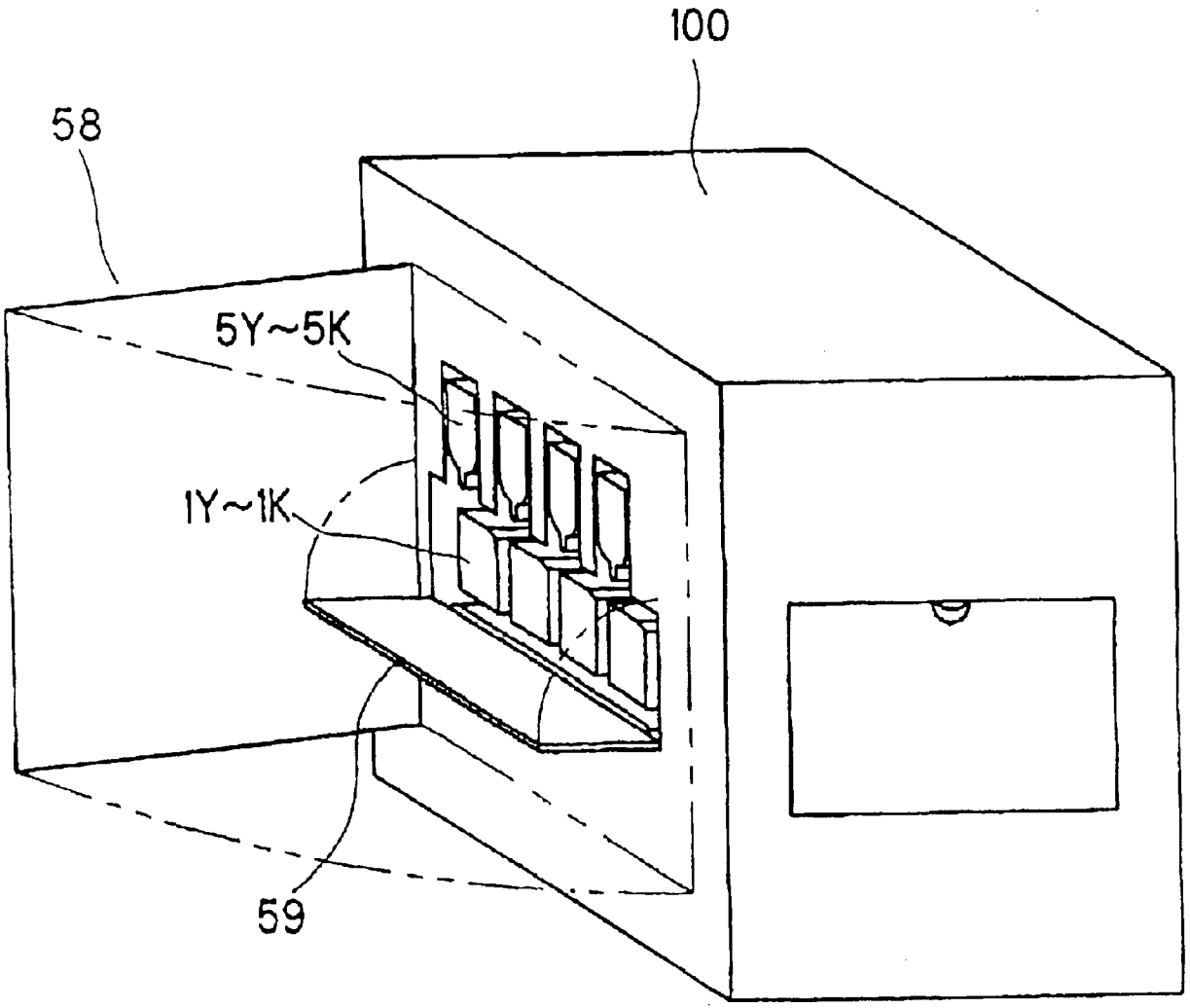
FIG. 3 is a schematic perspective view showing the image forming apparatus body according to this embodiment.

As shown in FIG. 3, a front door 58 which can be opened and closed is provided in the front of the apparatus body 1000. When the front door 58 is opened in the direction toward the front side, opening portions which allow the insertion of the process cartridges 1 and the toner replenishing containers 5 are exposed.

A pivotably supported centering plate 59 is placed on the opening portions for inserting the process cartridges 1. When the process cartridges 1 are inserted or removed, the centering plate 59 is first opened before the insertion or the removal.

In the apparatus body 1000, as shown in FIG. 2, guide rails 60 which guide the mounting of the process cartridges 1 and guide rails 61 which guide the mounting of the toner replenishing containers 5 are fixed.

A direction of mounting the process cartridges 1 and the toner replenishing containers 5 is parallel to the axial direction of the photosensitive drum 2. The guide rails 60, 61 are placed in the same direction as the mounting direction.

The process cartridges 1 and the toner replenishing containers 5 are slid and inserted from the front side to the rear side in the apparatus body 1000 along the guide rails 60, 61.

When the process cartridges 1 are completely inserted into the rearmost side, as shown in FIG. 4, centering shafts 66 of the apparatus body 1000 are inserted into center holes 2*f* of the drum flanges 2*b* so that the center positions of rotation on the rear sides of the photosensitive drums 2 are determined with respect to the apparatus body 1000.

At the same time, drive transmission portions 2*g* which are formed on the drum flanges 2*b* are connected to driving couplings (convex) 62*a* so that photosensitive drums 2 can be rotatably driven. In this embodiment, the drive transmission portion 2*g* has a twisted triangular shape, wherein when a driving force from the apparatus body 1000 is imparted to the drive transmission portion 2*g*, a force which pulls the photosensitive drum 2 into the rear side is generated.

A support pin 63 for positioning each process cartridge 1 is arranged on a back side plate 65. The support pin 63 is inserted into a frame of the process cartridge 1 so that the position of the frame of the process cartridge 1 is fixed.

The pivotable centering plate 59 is placed on the front side of the apparatus body 1000. A bearing case 2*c* of each of the process cartridges 1 is supported and fixed to this centering plate 59. By such a series of inserting operations, the process cartridges 1 including the photosensitive drums 2 can be positioned with respect to the apparatus body 1000.

On the other hand, when the toner replenishing containers replenishing containers 5 are completely inserted to the rearmost side, the toner replenishing containers 5 are fixed to support pins protruding from the back side plate 65. At the same time, the drive couplings (concave) and the drive couplings (convex) are connected to each other and the screws 5*a* and the agitating shafts 5*c* can be rotatably driven.

Then, the constitutional features of the present invention are explained in conjunction with FIG. 5 to FIG. 9.

First of all, an insulating sheet member 70 which constitutes a second sheet member is explained. The insulating sheet member 70 is constituted of an insulating sheet 70*a* and a laminating member 70*b*.

The insulating sheet 70*a* is made of polyurethane in a sheet shape having a flexibility of JISA hardness of not less than 50° and not more than 110° defined in K-6253 of the JIS standard and a thickness of not less than 30 $\mu$m and not more than 120 $\mu$m. Further, the insulating sheet 70*a* is formed in a shape projected from the laminating member 70*b* and is fixed to the laminating member 70*b* using a pressure sensitive adhesive double coated tape.

The laminating member 70*b* is a sheet-like resin member and is preferably made of resin having excellent strength such as polyethylene terephthalate (PET), polyacetal (POM), for example.

Further, the insulating sheet member 70 is fixed to the surface of the regulating blade 4*c* such that the distal end of the insulating sheet 70*a* is projected from the regulating blade 4*c* using a pressure sensitive adhesive double coated tape.

Here, as viewed from the distal end of the regulating blade 4*c*, an upper end 70*b*1 of the laminating member 70*b* assumes a lower position and a distal end 70*a*1 of the insulating sheet 70*a* assumes an upper position.

Further, with the provision of the laminating member 70*b*, at the time of assembling, it is possible to suppress the irregularities of a projection amount of the distal end of the insulating sheet 70*a* from the regulating blade 4*c* and, at the same time, wrinkling and waving of the insulating sheet 70*a* can be prevented. It is needless to say that the laminating member 70*b* may be omitted.

Figure 5:
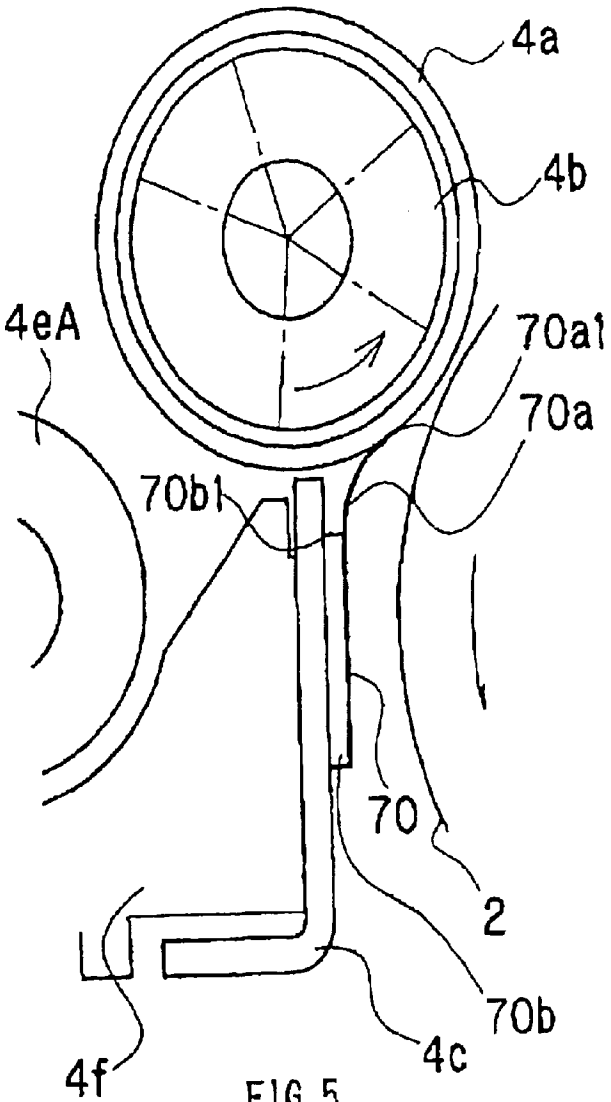
FIG. 5 is a cross-sectional view substantially showing an insulation sheet member according to this embodiment.
Figure 6:
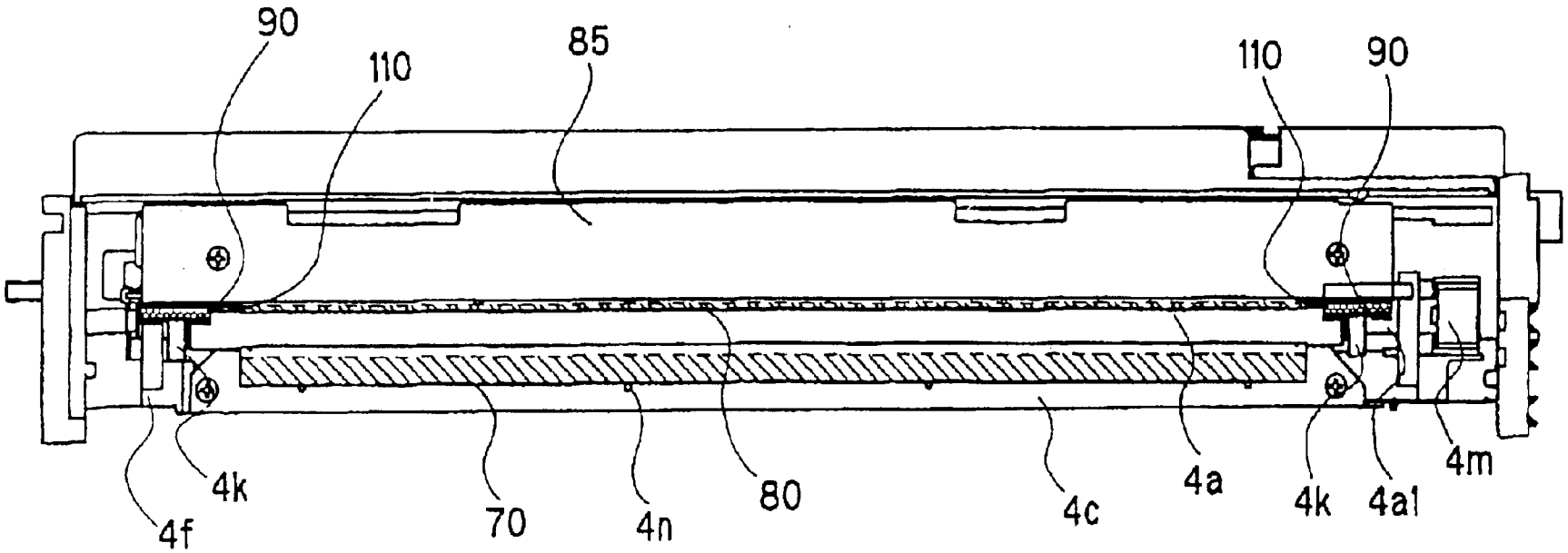
FIG. 6 is a longitudinal schematic view showing a developer according to this embodiment.

The distal end 70*a*1 of the insulating sheet 70*a* has a free length of 3 to 5 mm such that the distal end 70*a*1 is brought into contact with the developer layer after passing the regulating blade 4*c* at the upstream of the developing region in the rotational direction of the developing sleeve 4*a*. As shown in FIG. 5, the free length is a length from the distal end 70*a*1 of the insulating sheet 70*a* to the upper end 70*b*1 of the laminating member 70*b*. There is no limit with respect to the free length provided that the length is set such that the insulating sheet 70*a* is brought into contact with the developer layer, but the insulating sheet 70*a* does not invade the developing region.

Along with the lapse of use time of the developing device 4, the deterioration of the developer (non-magnetic toner and magnetic carrier) gradually progresses and hence, toner with an insufficient charging quantity (low triboelectrified toner) is generated and the low triboelectrified toner is gradually accumulated in the inside of the developing device 4. The low triboelectrified toner exhibits a low electrostatic attraction force to the magnetic carrier and hence, the toner is liable to be easily liberated from the magnetic carrier. Accordingly, when the low triboelectrified toner reaches the gap between the developing sleeve 4*a* and the regulating blade 4*c*, the toner stays and is coagulated in the gap whereby the toner is gradually accumulated as a block.

However, since the insulating sheet member 70 is directly brought into contact with the developing layer, it is possible to prevent falling of the toner block accumulated in the gap between the developing sleeve 4*a* and the regulating blade 4*c*. At the same time, since the toner block is subjected to the scraping of the magnetic brush which moves along with the rotation of the developing sleeve 4*a*, the coagulation of the toner block is loosened and the toner slips in the gap little by little, whereby it is possible to prevent the toner block from being excessively accumulated in the gap between the developing sleeve 4*a* and the regulating blade 4*c*.

Further, the insulating sheet member 70 suppresses air flow from the developer containing portion 4*h* generated by the rotation of the agitating screws 4*e*A, 4*e*B and the developing sleeve 4*a* over the whole longitudinal area of the opening portion defined between the developing sleeve 4*a* and the regulating blade 4*c*.

An insulating sheet member 80 which constitutes a first sheet member is made of polyurethane in a sheet shape having a JISA hardness of not less than 50° and not more than 110° defined in K-6253 of the JIS standard and a thickness of not less than 30 $\mu$m than 120 $\mu$m.

The insulating sheet member 80 is fixed to the cover member 85 located above the developing sleeve 4*a* covering the whole longitudinal area of the developing sleeve 4*a* using a pressure sensitive adhesive double coated tape.

Further, the insulating sheet member 80 is formed such that a distal end thereof is projected from a cover member 85.

The insulating sheet member 80 is brought into contact with the photosensitive drum 2, interrupts the air flow generated by the rotation of the photosensitive drum 2, and suppresses scattering of toner above the developing sleeve 4*a*.

Subsequently, sealing members 90 are explained. The sealing members 90 are made of an elastic body, a surface of which is covered with woven material.

The sealing members 90 are fixed to the cover member 85 using a pressure sensitive adhesive double coated tape and are positioned upstream of positions (two longitudinal portions) where the developing spacers 4*k* are brought into contact with the photosensitive drum 2. The sealing members 90 are provided for preventing the toner and the carrier adhered to the surface of the photosensitive drum 2 from being adhered to the developing spacers 4*k*.

The sealing member 90 is brought into contact with the photosensitive drum 2 in a range covering 20 mm at respective sides of the developing spacer 4*k*. Further, the sealing member 90 is positioned outside the insulating sheet member 70 and the insulating sheet member 80.

On the other hand, sealing members 100 are made of a elastic body having a felt-like surface. The sealing member 100 is fixed to arcuate portions 4*q* of the developing device 4 defining fixed gaps with the circumference of the developing sleeve 4*a* using a pressure sensitive adhesive double coated tape. The arcuate portions 4*q* of the developing device 4 are positioned at both longitudinal ends of the opening portion of the developer containing portion 4*h*. The positions of the arcuate portions 4*q* substantially correspond to both ends of the insulating sheet member 70 and the insulating sheet member 80.

Further, sealing members 110 are made of a foamed elastic member and are brought into contact with the photosensitive drum 2 and the developing sleeve 4*a* and sealing members 100. The sealing members 110 are filled in a gap defined between the cover member 85 and the developing sleeve 4*a* in the side of both longitudinal ends of the developing sleeve 4*a*. With respect to the longitudinal position of the sealing members 110, they are disposed between the sealing member 90 and the insulating sheet member 80.

Figure 9:
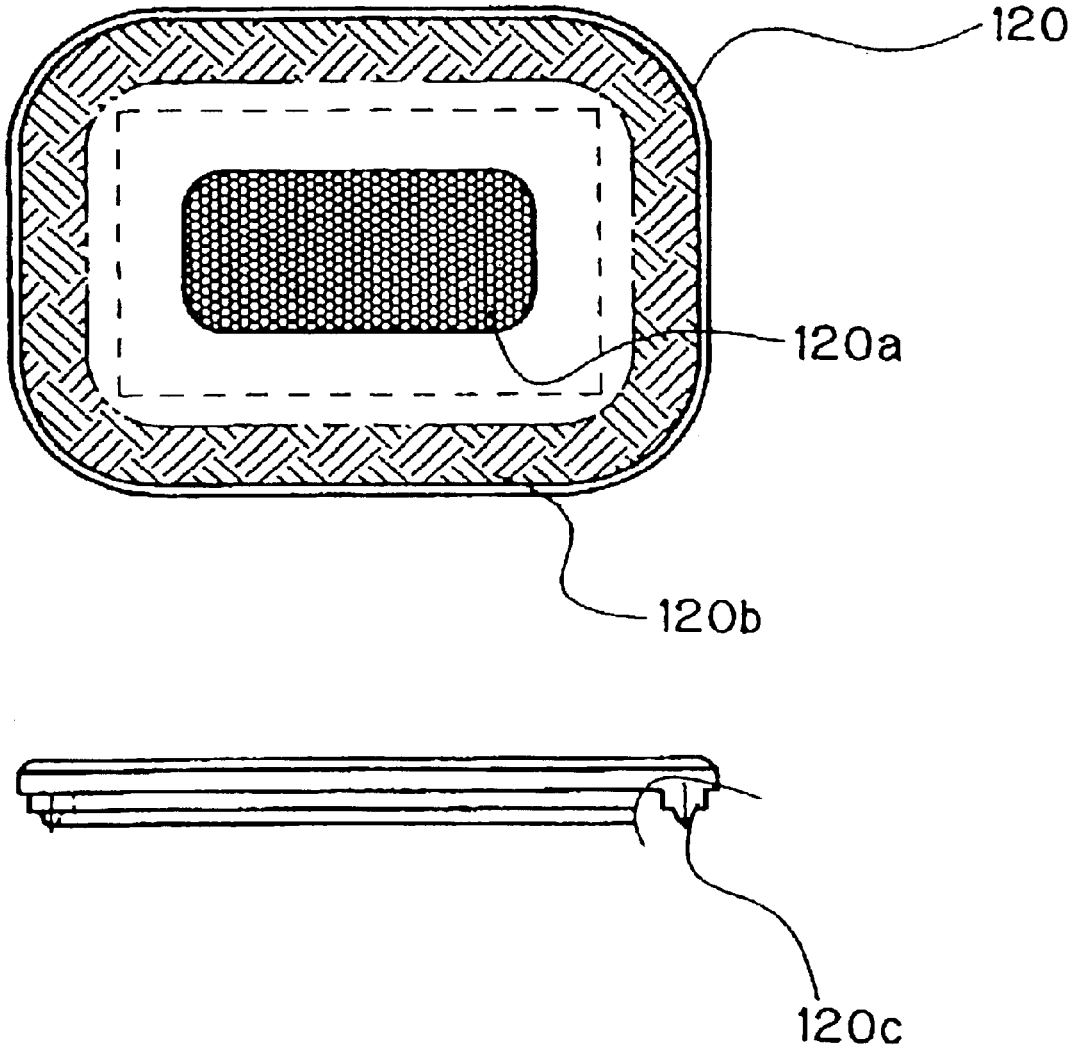
FIG. 9 is a schematic view showing a filter member according to this embodiment.

Subsequently, a filter member 120 is explained. As shown in FIG. 9, the filter member 120 is constituted of a resin member 120*b* and a filter 120*a*.

Figure 7:
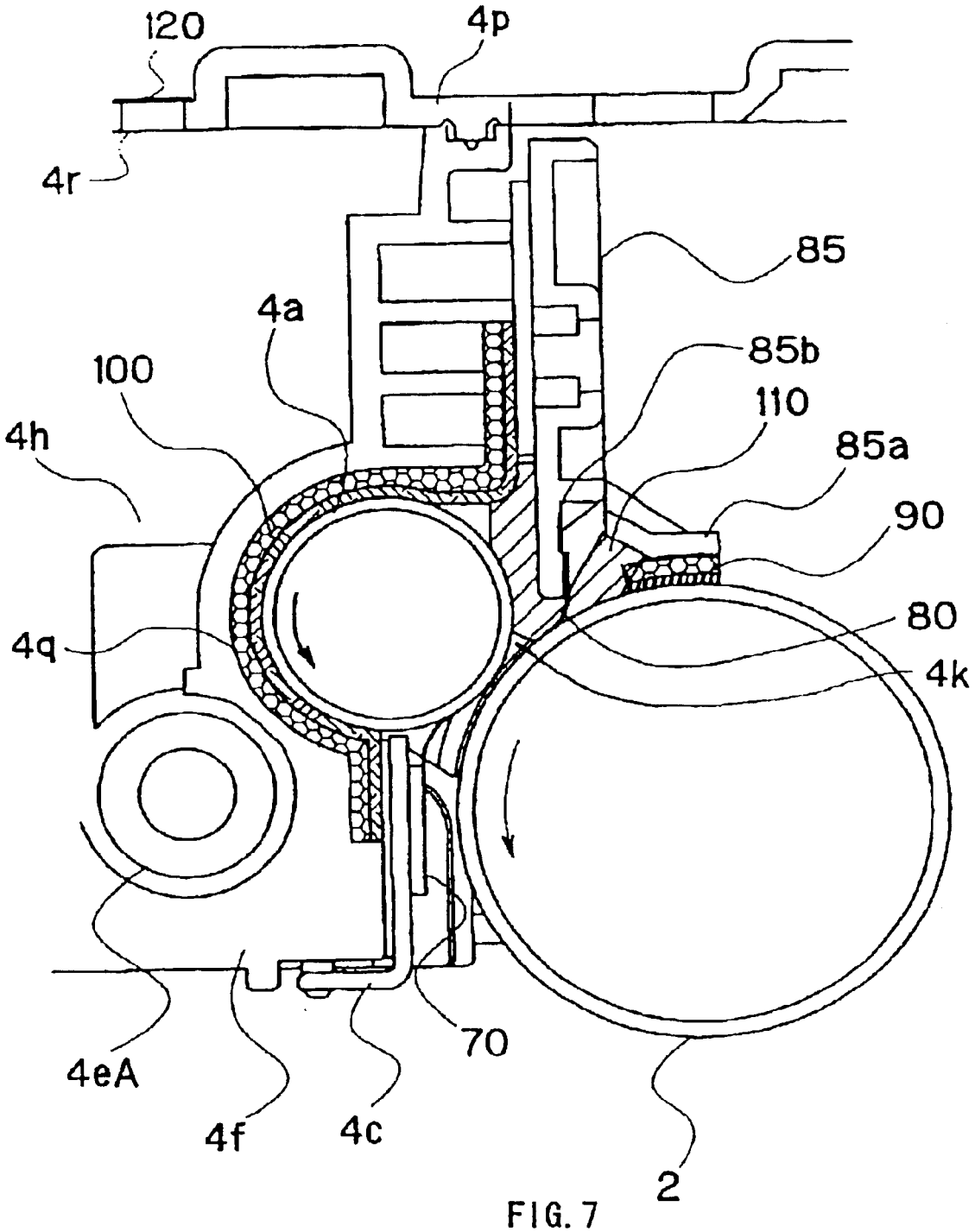
FIG. 7 is a cross-sectional view substantially showing both end portions of a developing sleeve according to this embodiment.

As shown in FIG. 7, the filter member 120 is fixed to a periphery of a vent port 4*r* of the developer containing portion 4*h* and covers the vent port 4*r*.

Figure 8:
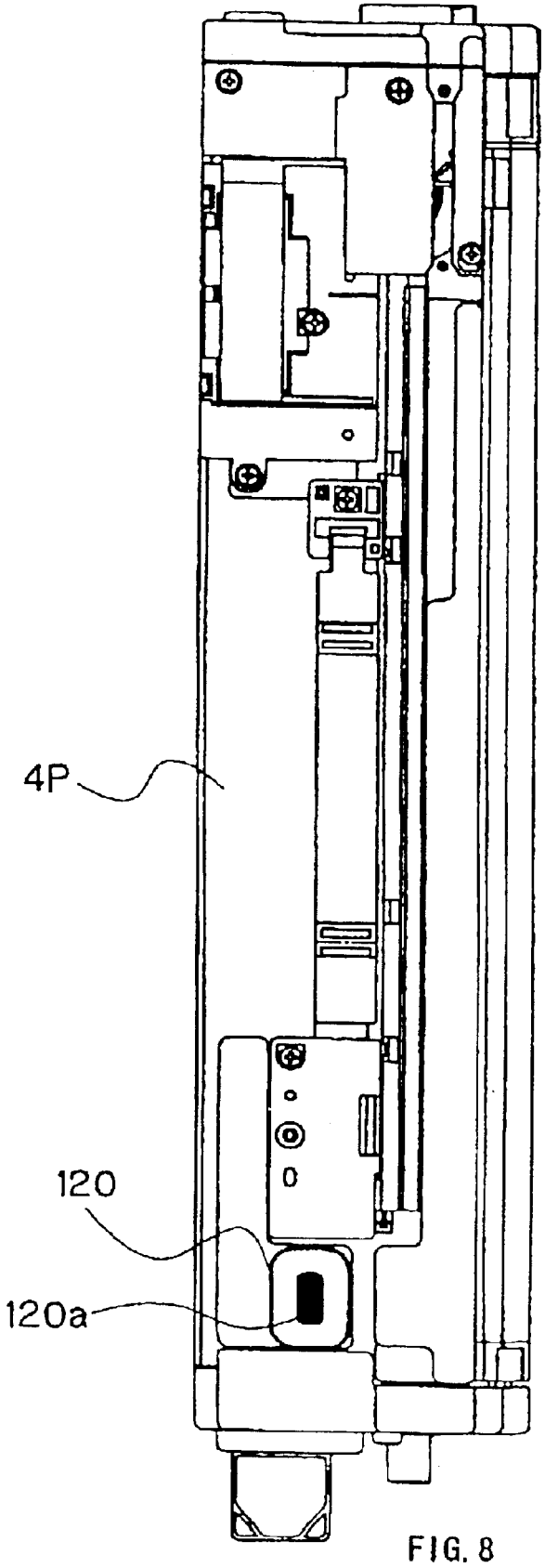
FIG. 8 is an upper plan view showing the process cartridge according to this embodiment.

Further, a fused rib 120*c* is formed on the resin member 120*b*, wherein the fused rib 120*c* is fixedly mounted on a developing container lid 4*p* shown in FIG. 8 by ultrasonic welding.

As described above, by sealing both longitudinal ends of the developing sleeve 4*a* by means of the insulating sheet member 70, the insulating sheet members 80, the sealing members 90, the sealing members 100 and the sealing members 110, the occurrence of the air flow which may cause toner scattering can be interrupted. However, the inner pressure of the developer containing portion 4*h* is elevated. Accordingly, a vent port 4*r* is formed in the developer containing portion 4*h*.

The vent port 4*r* is covered with a filter 120*a* having a mesh which prevents the developer from passing through the filter 120*a*. That is, the filter 120*a* constitutes means which can prevent the elevation of inner pressure while preventing leaking of the toner and carrier from the vent port 4*r*.

As has been described heretofore, according to this embodiment, by sealing the opening portion of the developer containing portion including the developer bearing member using the sheet members and the sealing members, and at the same time, by adjusting the inner pressure of the developer containing portion while preventing leaking of the developer using the filter, it is possible to prevent scattering of the developer which may be caused by the air flow and to prevent smearing of the process cartridge and the inside of the image forming apparatus and the lowering of image quality. Further, it is also possible to prevent a user from being smeared when the user exchanges the cartridge.

As has been described heretofore, the present invention can obtain the advantageous effect that with the provision of the vent port, the sheet members and the sealing members, it is possible to prevent leaking of the developer from the developing device or the process cartridge by preventing the elevation of the inner pressure of the developer containing portion. Further, it is also possible to prevent leaking of the developer and scattering of the developer into the exposure optical path which is caused by leaking of the developer.

What is claimed is:

1. A developing device for developing a latent image formed on an electrophotographic photosensitive member used in an electrophotographic image forming apparatus, said developing device comprising:

a developing member configured and positioned to develop a latent image formed on the electrophotographic photosensitive member;

an exposure optical path configured and positioned to guide an exposure light emitted from exposure means mounted in a body of the electrophotographic image forming apparatus to the electrophotographic photosensitive member;

a developer containing portion configured and positioned to contain a developer which is used by said developing member for developing the latent image;

a vent port configured and positioned to allow air in the inside of said developer containing portion to pass therethrough;

a cover member extending along a longitudinal direction of said developing member, said cover member being disposed between said exposure optical path and said developing member in the rotational direction of the electrophotographic photosensitive member, a first sheet member configured and positioned to prevent scattering of the developer into said exposure optical path, said first sheet member being disposed on said cover member and being in contact with the electrophotographic photosensitive member in the longitudinal direction of the electrophotographic photosensitive member;

a first sealing member configured and positioned to prevent leaking of the developer in the inside of said developer containing portion from said developer containing portion, said first sealing member being in contact with one end portion of the electrophotographic photosensitive member, one end portion of said developing member and one end portion of said cover member in the longitudinal direction of the electrophotographic photosensitive member; and a second sealing member configured and positioned to prevent leaking of the developer in the inside of said developer containing portion from said developer containing portion, said second sealing member being in contact with another end portion of the electrophotographic photosensitive member, another end portion of said developing member and another end portion of said cover member in the longitudinal direction of the electrophotographic photosensitive member.

2. A developing device according to claim 1, wherein said vent port is covered with a filter which prevents the developer from passing therethrough.

3. A developing device according to claim 2, wherein the filter is combined with a resin member and the resin member is welded to said developing device by ultrasonic welding.

4. A developing device according to claim 1, wherein said vent port is formed in an upper surface of said developer containing portion in a state that said developing device is mounted on the body of the electrophotographic image forming apparatus.

5. A developing device according to claim 1, wherein said developing device further includes:

a layer thickness restricting member configured and positioned to restrict a layer thickness of the developer carried on a peripheral surface of said developing member to a given layer thickness, said layer thickness restricting member being arranged over said developing member with a given distance therebetween, and a second sheet member configured and positioned to prevent the developer fallen from said developing member due to said layer thickness restricting member from leaking to the outside of said developing device, said second sheet member being mounted on said layer thickness restricting member and being in contact with said developing member.

6. A developing device according to claim 1, wherein said first sheet member is made of a resin material and is formed in a sheet shape.

7. A developing device according to claim 1, wherein said first sealing member and said second sealing member are made of a foamed elastic member.

8. A developing device according to claim 7, wherein said first sheet member is made of polyurethane resin.

9. A process cartridge which is detachably attachably mounted on a body of an electrophotographic image forming apparatus, said process cartridge comprising:

an electrophotographic photosensitive member;

a developing member configured and positioned to develop a latent image formed on said electrophotographic photosensitive member;

an exposure optical path configured and positioned to guide an exposure light emitted from exposure means mounted in the body of the electrophotographic image forming apparatus to said electrophotographic photosensitive member;

a developer containing portion configured and positioned to contain a developer which is used by said developing member for developing the latent image;

a vent port configured and positioned to allow air in the inside of said developer containing portion to pass therethrough;

a cover member extending along a longitudinal direction of said developing member, said cover member being disposed between said exposure optical path and said developing member in the rotational direction of said electrophotographic photosensitive member, a first sheet member configured and positioned to prevent scattering of the developer into said exposure optical path, said first sheet member being disposed on said cover member and being in contact with said electrophotographic photosensitive member in the longitudinal direction of said electrophotographic photosensitive member;

a first sealing member configured and positioned to prevent leaking of the developer in the inside of said developer containing portion from said developer containing portion, said first sealing member being in contact with one end portion of said electrophotographic photosensitive member, one end portion of said developing member, and one end portion of said cover member in the longitudinal direction of said electrophotographic photosensitive member; and a second sealing member configured and positioned to prevent leaking of the developer in the inside of said developer containing portion from said developer containing portion, said second sealing member being in contact with another end portion of said electrophotographic photosensitive member, another end portion of said developing member, and another end portion of said cover member in the longitudinal direction of said electrophotographic photosensitive member.

10. A process cartridge according to claim 9, wherein said vent port is covered with a filter which prevents the developer from passing therethrough.

11. A process cartridge according to claim 10, wherein the filter is combined with a resin member and the resin member is welded to said process cartridge by ultrasonic welding.

12. A process cartridge according to claim 9, wherein said vent port is formed in an upper surface of said developer containing portion in a state that said process cartridge is mounted on the body of the electrophotographic image forming apparatus.

13. A process cartridge according to claim 9, wherein said process cartridge further includes:

a layer thickness restricting member configured and positioned to restrict a layer thickness of the developer carried on a peripheral surface of said developing member to a given thickness, said layer thickness restricting member being arranged over said developing member with a given distance therebetween, and a second sheet member configured and positioned to prevent the developer fallen from said developer member due to said layer thickness restricting member from leaking to the outside of said developing device, said second sheet member being mounted on said layer thickness restricting member and being in contact with said developing member.

14. A process cartridge according to claim 9, wherein said first sheet member is made of a resin material and is formed in a sheet shape.

15. A process cartridge according to claim 9, wherein said first sealing member and said second sealing member are made of a foamed elastic member.

16. A process cartridge according to claim 14, wherein said first sheet member is made of polyurethane resin.

17. An electrophotographic image forming apparatus for forming an image on a recording medium, said electrophotographic image forming apparatus comprising:

(a) exposure means;

(b) a developing device configured and positioned to develop a latent image formed on an electrophotographic photosensitive member used in said electrophotographic image forming apparatus, said developing device including a developing member configured and positioned to develop the latent image formed on the electrophotographic photosensitive member, an exposure optical path configured and positioned to guide an exposure light emitted from exposure means mounted in a body of said electrophotographic image forming apparatus to the electrophotographic photosensitive member, a developer containing portion configured and positioned to contain a developer which is used by said developing member for developing the latent image, a vent port configured and positioned to allow air in the inside of said developer containing portion to pass therethrough, a cover member extending along a longitudinal direction of said developing member, said cover member being disposed between said exposure optical path and said developing member in the rotational direction of the electrophotographic photosensitive member, a first sheet member configured and positioned to prevent scattering of the developer into said exposure optical path, said first sheet member being disposed on said cover member and being in contact with the electrophotographic photosensitive member in the longitudinal direction of the electrophotographic photosensitive member, a first sealing member configured and positioned to prevent leaking of the developer in the inside of said developer containing portion from said developer containing portion, said first sealing member being in contact with one end portion of the electrophotographic photosensitive member, one end portion of said developing member and one end portion of said cover member in the longitudinal direction of the electrophotographic photosensitive member, and a second sealing member configured and positioned to prevent leaking of the developer in the inside of said developer containing portion from said developer containing portion, said second sealing member being in contact with another end portion of the electrophotographic photosensitive member, another end portion of said developing member, and another end portion of said cover member in the longitudinal direction of the electrophotographic photosensitive member; and (c) conveying means for conveying the recording medium.

18. An electrophotographic image forming apparatus for forming an image on a recording medium on which a process cartridge can be detachably attachably mounted, said electrophotographic image forming apparatus comprising:

(a) exposure means;

(b) mounting means for detachably mounting the process cartridge which includes an electrophotographic photosensitive member, a developing member configured and positioned to develop a latent image formed on the electrophotographic photosensitive member, an exposure optical path configured and positioned to guide an exposure light emitted from exposure means mounted in a body of said electrophotographic image forming apparatus to the electrophotographic photosensitive member, a developer containing portion configured and positioned to contain a developer which is used by the developing member for developing the latent image, a vent port configured and positioned to allow air in the inside of the developer containing portion to pass therethrough, a cover member extending along a longitudinal direction of the developing member, the cover member being disposed between the exposure optical path and the developing member in the rotational direction of the electrophotographic photosensitive member, a first sheet member configured and positioned to prevent scattering of the developer into the exposure optical path, the first sheet member being disposed on the cover member and being in contact with the electrophotographic photosensitive member in the longitudinal direction of the electrophotographic photosensitive member, a first sealing member configured and positioned to prevent leaking of the developer in the inside of the developer containing portion from the developer containing portion, the first sealing member being in contact with one end portion of the electrophotographic photosensitive member, one end portion of the developing member and one end portion of the cover member in the longitudinal direction of the electrophotographic photosensitive member, and a second sealing member configured and positioned to prevent leaking of the developer in the inside of the developer containing portion from the developer containing portion, the second sealing member being in contact with another end portion of the electrophotographic photosensitive member, another end portion of the developing member, and another end portion of the cover member in the longitudinal direction of the electrophotographic photosensitive member; and (c) conveying means for conveying the recording medium.

* * * * *

UNITED STATES PATENT AND TRADEMARK OFFICE

CERTIFICATE OF CORRECTION

PATENT NO. : 6,823,153 B2
DATED : November 23, 2004
INVENTOR(S) : Takahito Ueno et al.

It is certified that error appears in the above-identified patent and that said Letters Patent is hereby corrected as shown below:

Column 1,
Lines 49, 50 and 52, “life time” should read -- lifetime --.

Column 7,
Line 36, “is-used” should read -- is used --.

Column 11,
Line 36, “lib” should read -- like --.

Signed and Sealed this

Twelfth Day of April, 2005

JON W. DUDAS
*Director of the United States Patent and Trademark Office*